US006248943B1

(12) United States Patent
Inoue

(10) Patent No.: US 6,248,943 B1
(45) Date of Patent: Jun. 19, 2001

(54) KEYBOARD MUSICAL INSTRUMENT HAVING DUMMY HAMMER WITH WELL-REGULATED CENTER OF GRAVITY FOR PRODUCING PIANO-LIKE KEY TOUCH WITHOUT ACOUSTIC SOUND

(75) Inventor: Satoshi Inoue, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/390,197

(22) Filed: Sep. 7, 1999

(30) Foreign Application Priority Data

Sep. 7, 1998 (JP) ..... 10-252968

(51) Int. Cl.[7] ..... G10C 3/12
(52) U.S. Cl. ..... 84/423 R; 84/433; 84/434
(58) Field of Search ..... 84/423 R, 433, 84/434, 435, 436, 437, 441, 442, 447, 448

(56) References Cited

U.S. PATENT DOCUMENTS 5,583,306 * 12/1996 Hayashida et al. ..... 84/171
5,583,310 * 12/1996 Sugiyama et al. ..... 84/719
5,594,188 * 1/1997 Kawamura ..... 84/171
5,612,502 * 3/1997 Ura ..... 84/687
5,616,880 * 4/1997 Hayashida et al. ..... 84/719
5,652,403 * 7/1997 Sugiyama et al. ..... 84/708
5,811,702 9/1998 Tomizawa et al. .
5,874,687 * 2/1999 Kawamura ..... 84/719
5,880,389 * 3/1999 Muramatsu ..... 84/615
6,054,641 * 4/2000 Inoue ..... 84/171

FOREIGN PATENT DOCUMENTS 9-179545 7/1997 (JP) .

* cited by examiner

*Primary Examiner*—Robert E. Nappi
*Assistant Examiner*—Kim Lockett
(74) *Attorney, Agent, or Firm*—Morrison & Foerster

(57) ABSTRACT

A keyboard musical instrument is a combination of an acoustic upright piano without strings and an electronic tone generating system, and a hammer receiver is beaten with hammers respectively linked with key action mechanisms, wherein the each of the hammers has a hammer shank fixed to a butt of the key action mechanism and a weight member attached to the hammer shank, and the weight member has a center of gravity in the vicinity of the center of gravity in a hammer head of a regular hammer usually incorporated in the standard upright piano so that the key touch is identical with or similar to that of the piano key touch.

24 Claims, 5 Drawing Sheets

KEYBOARD MUSICAL INSTRUMENT HAVING DUMMY HAMMER WITH WELL-REGULATED CENTER OF GRAVITY FOR PRODUCING PIANO-LIKE KEY TOUCH WITHOUT ACOUSTIC SOUND

FIELD OF THE INVENTION

This invention relates to a keyboard musical instrument and, more particularly, to a keyboard musical instrument like an acoustic upright piano and equipped with dummy hammers allowing a player to finger a piece of music without acoustic sound.

DESCRIPTION OF THE RELATED ART

A typical example of the keyboard musical instrument has a keyboard, which has black keys and white keys laid out on the pattern of the acoustic piano. The black keys and the white keys are linked with key action mechanisms, and hammers are respectively driven for rotation by the key action mechanisms as similar to the acoustic piano. Key sensors respectively monitor the motions of the black/white keys, and send pieces of positional information representative of the variation of the keys to a tone generator. The tone generator determines the notes of the scale to be generated and the timings for the sound generation on the basis of the pieces of positional information. The sound generator supplies a sound signal to a speaker system or a headphone at the appropriate timings, and the speaker system or the headphone converts the sound signal to the acoustic piano sound.

FIG. 1 illustrates the essential parts of the prior art keyboard musical instrument. Though not shown, the prior art keyboard musical instrument has a case like that of an acoustic upright piano. The essential parts form key action mechanisms 1, hammers 2, damper mechanisms 3 and a receiving member 4, and the key action mechanisms 1, the hammers 2, the damper mechanisms 3 and the receiving member 4 are installed inside the case. Black keys 5*a* and white keys 5*b* are laid out on the patter of the acoustic upright piano, and form in combination a keyboard 5. The keyboard 5 is placed on a key bed 6*a,* which forms a part of the case. The black keys 5*a* and the white keys 5*b* turn around a balance rail 6*b* like a seesaw.

Each of the key action mechanisms 1 is associated with one of the black/white keys 5*a*/5*b,* and is placed over the rear end portion of the associated black/white key 5*a*/5*b*. The key action mechanism 1 has a jack 1*a* turnably supported by a whippen assembly 1*b*. The whippen assembly 1*b* and a butt 1*c* are turnably supported by a center rail 7. The jack 1*a* is moved together with the whippen assembly 1*b,* and turns with respect to the whippen assembly 1*b*. A regulating button 1*d* is provided on a trajectory of the jack moved together with the whippen assembly 1*b*. A capstan button 5*c* upwardly projects from the rear end portion of each black/white key 5*a*/5*b,* and is held in contact with the whippen assembly 1*b*.

A hammer shank 2*a* and a hammer head 2*b* form in combination the hammer 2, and the hammer shank 2*a* is fixed to the butt 1*c*. The hammer head 2*b* is corresponding to the hammer top felt of the hammer incorporated in the acoustic upright piano. However, the hammer head 2*b* is shaped into a different configuration from the hammer top felt used in the acoustic upright piano. The hammer head 2*b* is like a column, and has a center of gravity on an extension of the center line of the hammer shank 2*a*. While the associated black/white key 5*a*/5*b* is staying in the rest position, the jack 1*a* is held in contact with the lower surface of the butt 1*c,* and the hammer head 2*b* is spaced from the receiving member 4.

The receiving member 4 does not have any string, and is beaten by the hammer head 2*b*. The receiving member 4 does not vibrate like the strings, nor generate the acoustic piano sound. The damper mechanism 3 is also supported by the center rail 7, and has a damper lever 3*a* driven for rotation by a damper spoon 3*b* fixed to the whippen assembly 1*b*. Thus, the damper mechanism 3 is like the damper mechanism of the acoustic upright piano. However, the damper mechanism 3 does not have any damper head. This is because of the fact that the prior art keyboard musical instrument does not have any string to vibrate upon strike with the hammer head 2*b*.

When a player depresses one of the black/white keys 5*a*/5*b,* the black/white key 5*a*/5*b* is moved from the rest position toward the end position, and the capstan button 5*c* upwardly pushes the whippen assembly 1*b*. The whippen assembly 1*b* turns in the counter clockwise direction, and the jack is moved together with the whippen assembly 1*b*. The toe of the jack 1*a* is getting closer and closer to a regulating button 1*d*. When the toe is brought into contact with the regulating button 1*d,* the reaction makes the jack 1*a* turn in the clockwise direction with respect to the whippen assembly 1*b,* and the other end of the jack 1*a* kicks the butt 1*c*. The butt 1*c* is rotated in the counter clockwise direction, and escapes from the jack 1*a*. The hammer head 2*b* strikes the receiving member 4, and rebounds. When the butt 1*c* escapes from the jack 1*a,* the player feels the black/white key 5*a*/5*b* lighter, and the change is unique like the touch on the keyboard of the acoustic upright piano. The key motion is monitored by the key sensors, and the tone generator and the speaker system generate electronic sound.

The hammers 2 are simpler than the hammers incorporated in the acoustic upright piano, and the manufacturer produces the hammers 2 at a low cost. The key action mechanisms 1, the damper mechanisms 3 and the keyboard 5 are smaller and simpler than those of a grand piano, and, accordingly, the manufacturer can produce the essential parts at a lower cost. The manufacturer assembles the key action mechanisms 1 with the simple hammers 2, and offers the prior art keyboard musical instrument to users at a low price. For this reason, the prior art keyboard musical instrument is spread over the market. However, some users do not satisfy the prior art keyboard musical instrument. They express their dissatisfaction at the key touch.

SUMMARY OF THE INVENTION

It is therefore an important object of the present invention to provide a keyboard musical instrument, which offers a key touch identical with the key touch of an acoustic upright piano.

The present inventor contemplated the key touch different from that of the acoustic upright piano, and noticed that the hammer head 2*b* was different in center of gravity from a hammer head, i.e., a hammer felt 8 assembled with a hammer wood 10 of the acoustic upright piano (see FIG. 2). Although the hammer head 2*b* had the center of gravity on the extension of the center line of the hammer shank 2*a,* the hammer felt 8 and the hammer wood 10 of the acoustic upright piano had the center of gravity offset from the center line of the hammer shank 9. The hammer head 2*b* exerted a moment on the butt 1*c* around the butt flange, and the hammer felt 8 and the hammer wood 10 also exerted a moment on the associated butt around the butt flange. If the center of gravity in the hammer head 2*b* was offset from the center of gravity in the hammer felt 8 and the hammer wood 10, the moments were different in magnitude, and differently offered the load against the jack. Thus, the difference in the center of gravity affected the escaping, and made the key touch different between the prior art keyboard musical instrument and the acoustic upright piano. The present inventor concluded that the simple hammer head was to have the center of gravity at the right position corresponding to that of the hammer felt 8 and the hammer wood 10.

To accomplish the object, the present invention proposes to offset the center of gravity in a weight from the center line of a hammer shank toward a hammer receiver.

In accordance with one aspect of the present invention, there is provided a keyboard musical instrument comprising a keyboard including plural keys independently turnable between respective rest positions and respective end positions and assigned notes of a scale, respectively, plural key action mechanisms similar to key action mechanisms of an acoustic upright piano, respectively linked with the plural keys, having respective butts and respective jacks and selectively actuated by depressed keys of the keyboard so as to rotate the butts through escapes from the jacks associated therewith, a hammer receiver to be struck without acoustic sound and plural hammers driven for rotation together with the butt for striking the hammer receiver and including respective hammer shanks having respective center lines and fixed to the associated butts and respective weight members attached to the associated hammer shanks and having centers of gravity closer to the hammer receiver than the center lines of the associated hammer shanks.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENTS

First Embodiment

Figure 3:
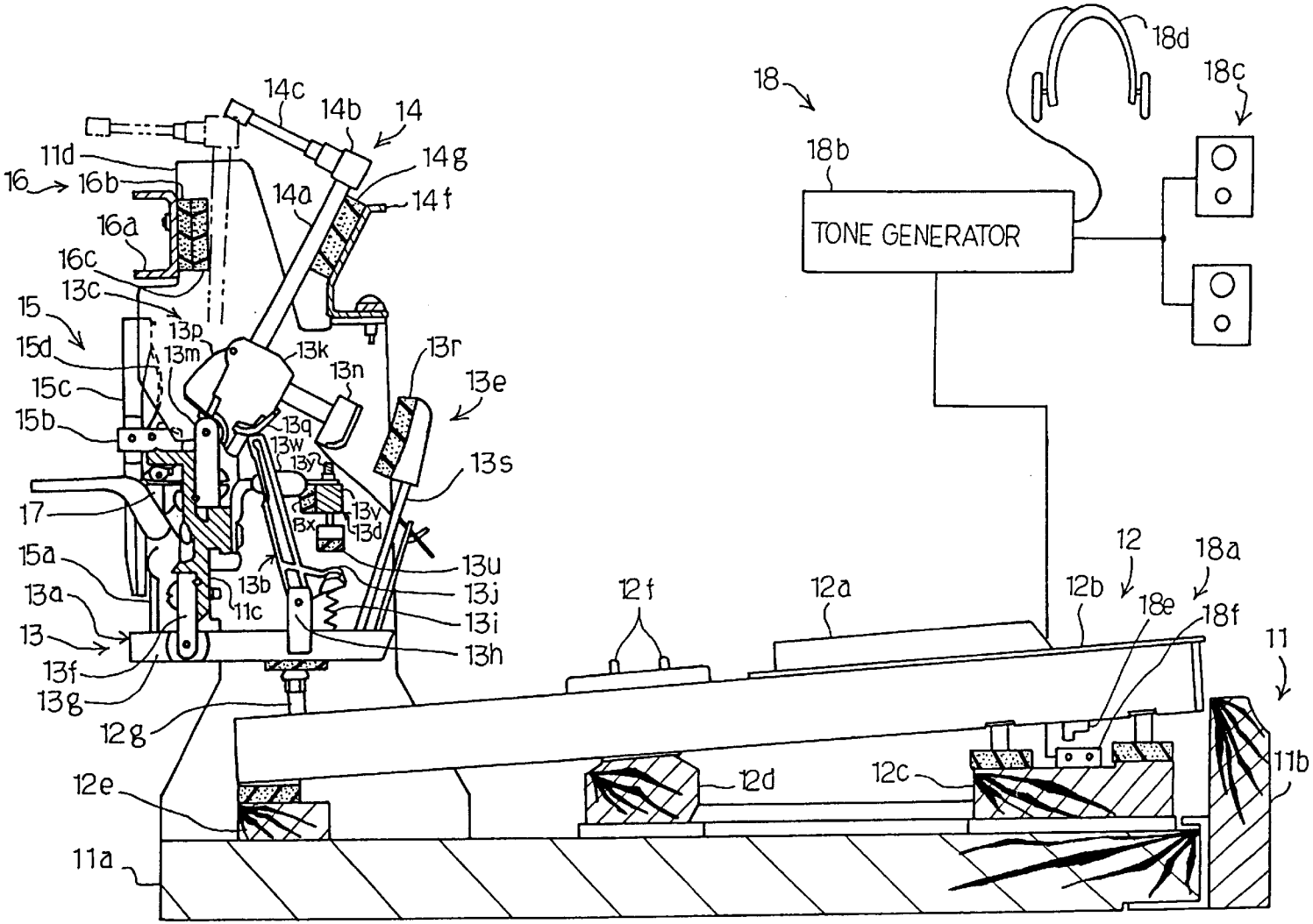
FIG. 3 is a side view showing the structure of a keyboard musical instrument according to the present invention.
Figure 4:
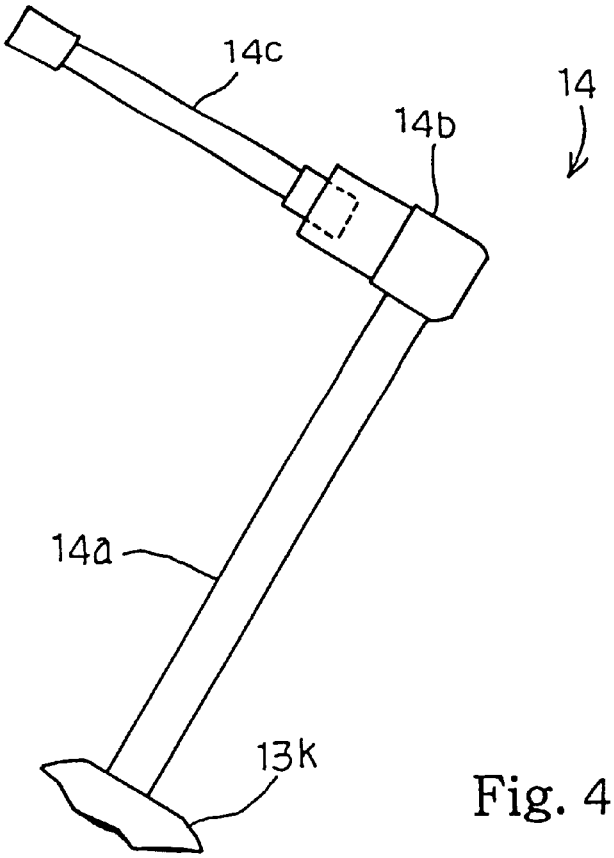
FIG. 4 is a side view showing the structure of a hammer incorporated in the keyboard musical instrument.

Referring to FIG. 3 of the drawings, a keyboard musical instrument embodying the present invention comprises a case 11 and a keyboard 12. In the following description, term "front" is indicative of a relative position closer to a player sitting for fingering a piece of music on the keyboard 12, and term "lateral" is indicative of a direction perpendicular to the direction between "front" and "rear". A key bed 11*a* and a key slip 11*b* form part of the case 11, and an inner space is defined in the case 11. The case 11 partially exposes the keyboard 12 to a player, and the case 11 and the keyboard 12 give an external appearance like an acoustic upright piano to the keyboard musical instrument. A center rail 11*c* laterally extends in the inner space over the keyboard 12, and is supported by action brackets 11*d* at both ends and intermediate points.

The keyboard 12 is placed on the key bed 11*a,* and includes black keys 12*a* and white keys 12*b,* a front rail 12*c,* a balance rail 12*d* and a back rail 12*e.* The front rail 12*c,* the balance rail 12*d* and the back rail 12*e* laterally extend in parallel on the key bed 11*a,* and are spaced from one another in the longitudinal direction. The black keys 12*a* and the white keys 12*b* are laid out on the pattern of an acoustic upright piano, and are independently turnable around the balance rail 12*d.* Notes of a scale are assigned to the black/white keys 12*a*/12*b.* Balance pins 12*f* keep the black keys 12*a* and the white keys 12*b* at the right positions. While any force is not exerted on the black keys 12*a* and the white keys 12*b,* the black keys 12*a* and the white keys 12*b* sink their rear end on the back rail cloth adhered to the back rail 12*e,* and are staying in the rest positions, respectively. Capstan screws 12*g* project from the rear end portions of the black/white keys 12*a*/12*b.*

The keyboard musical instrument further comprises key action mechanisms 13, hammers 14, dummy damper mechanisms 15 and a hammer receiver 16. The key action mechanisms 13, the hammers 14 and the dummy damper mechanisms 15 are accommodated in the inner space, and are located over the rear end portions of the black/white keys 12*a*/12*b.* The hammers 14 are assembled with the key action mechanisms 13, and the hammer receiver 16 is beaten with the hammers 14. The key action mechanisms 13 are actuated by the keyboard 12, and the hammers 14 are independently driven for rotation by the associated key action mechanisms 13. The hammers 14 beat the hammer receiver 16 without acoustic piano sound.

The key action mechanisms 13 are respectively associated with the black/white keys 12*a*/12*b,* respectively. The key action mechanisms 13 are similar in structure to one another, and only one key action mechanism 13 is described in detail. The key action mechanism 13 is broken down into a whippen assembly 13*a,* a jack 13*b,* a butt assembly 13*c,* a regulating button assembly 13*d* and a back-check 13*e.*

The whippen assembly has a whippen flange 13*f,* a whippen 13*g* and a jack flange 13*h.* The whippen flange 13*f* is fixed to the rear surface of the center rail 11*c,* and downwardly projects therefrom. The rear end portion of the whippen 13*g* is turnably connected to the whippen flange 13*f,* and the capstan button 12*g* is held in contact with the lower surface of the whippen 13*g.* The jack flange 13*h* is fixed to the intermediate portion of the whippen 13*f,* and upwardly projects therefrom. While the associated black/white key 12*a*/12*b* is staying in the rest position, the capstan button 12*g* keeps the whippen 13*g* substantially horizontal. The whippen 13*g* is rotated in the counter clockwise direction around the whippen flange 13*f* during the upward motion of the capstan button 12*g* and, accordingly, the motion of the associated key 12*a*/12*b* from the rest position toward the end position. The weight permits the whippen assembly 13*a* to turn in the clockwise direction after the release of the black/white key 12*a*/12*b.*

The jack 13*b* is turnably supported by the jack flange 13*h,* and a jack spring 13*i* urges the jack 13*b* to turn in the counter clockwise direction. The jack 13*b* is shaped into an L-letter configuration, and the jack 13*b* has a toe 13*j* at the leading end of the short portion. The jack 13*b* is held in contact with the butt assembly 13*c* at the leading end of the long portion thereof, and the regulating button assembly 13*d* is located over the toe 13*j*.

The butt assembly 13*c* has a butt 13*k*, a butt flange 13*m*, a catcher 13*n*, a butt spring 13*p* and a butt skin 13*q*. The hammer 14 and the catcher 13n are fixed to the butt 13*k*, and project therefrom in different directions. The butt 13*k* is turnably connected to the butt flange 13*m*, and the butt flange 13*m* is fixed to the front surface of the center rail 11*c*. The butt flange 13*m* keeps the butt 13*k* over the jack 13*b*, and the butt skin 13*q* is attached to a lower surface of the butt 13*k*. While the black/white key 12*a*/12*b* is in the rest position, the jack 13*b* is held in contact with the butt skin 13*q*. The toe 13*j* is brought into contact with the regulating button assembly 13*d* during the key motion from the rest position toward the end portion. Then, the jack 13*b* quickly turns around the jack flange 13*h*, and gives rise free rotation of the butt 13*k* in the counter clockwise direction around the butt flange 13*m*. Thus, the regulating button assembly 13*d* causes the butt 13*k* to escape from the jack 13*b*.

While the toe 13*j* is getting closer and closer to the regulating button assembly 13*d*, the capstan button 12*g* is expected to push the whippen assembly 13*a*, the jack 13*b*, the butt assembly 13*c* and the hammer 14 against the self-weight thereof, and the player feels the load at the finger heavy. When the toe 13*j* is brought into contact with the regulating button mechanism 13*d*, the reaction makes the jack 13*b* turn in the clockwise direction around the jack flange 13*h*, and the butt 13*k* escapes from the jack 13*b*. Then, the butt assembly 13*c* and the hammer 14 does not exerts the self-weight on the jack 13*b* and, accordingly, the capstan button 12*g*, and the player feels the load at the finger light. Thus, the key action mechanism 13 and the hammer 14 give the unique touch to the player.

The back check 13*e* has a back check block 13*r* supported by a back check wire 13*s* over the front end portion of the whippen 13*g*. The back check block 13*r* intersects the trajectory of the catcher 13*n*, and a bridle tape 13*t* is connected to the catcher 13*n*. After the escape from the jack 13*b*, the butt 13*k*, the catcher 13*n* and the hammer 14 is moved toward the hammer receiver 16 through the free rotation, and the hammer 14 rebounds on the hammer receiver 16. Then, the butt, 13*k*, the catcher 13*n* and the hammer 14 starts to turn in the clockwise direction. As described hereinbefore, the back check block 13*r* is on the trajectory of the catcher 13*n*, and the back check block 13*r* receives the catcher 13*n*. The player releases the black/white key 12*a*/12*b*, and the whippen 13*g* slightly turns in the clockwise direction around the whippen flange 13*f*. Then, the jack 13*b* slides into the lower space of the butt 13*k*. Thus, the bridle tape 13*t* links the hammer 14 with the whippen assembly 13*a*, and prevents the hammer receiver 16 from a double strike.

The regulating button assembly 13*d* has a regulating button 13*u*, a regulating rail 13*v*, a folk screw 13*w*, a jack stop rail felt 13*x* and a screw 13*y*. The folk screw 13*w* is fixed to the front surface of the center rail 11*c*, and supports the regulating rail 13*v* over the toe 13*j*. The regulating rail 13*v* laterally extends over the keyboard 12, and the jack stop rail felt 13*x* is attached to the rear surface of the regulating rail 13*v*. The jack stop rail felt 13*x* sets a limit on the stroke of the jack 13*b* after the escape. The regulating button 13*u* is fixed to the screw 13*y*, and the screw 13*y* is hung from the regulating rail 13*v*. The distance between the regulating rail 13*v* and the regulating button 13*u* is regulable, and, accordingly, the gap between the toe 13*j* and the regulating button 13*u* is also regulable. This means that a tuner can change the timing at which the toe 13*j* is brought into contact with the regulating button 13*u*. Thus, the escape timing is varied by regulating the gap.

Figure 5A:
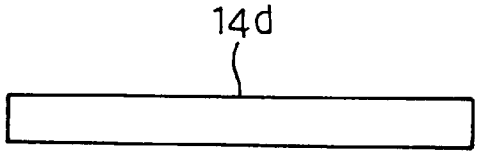
FIGS. 5A to 5C are side views showing three variations of a weight forming a part of the hammer.
Figure 5B:
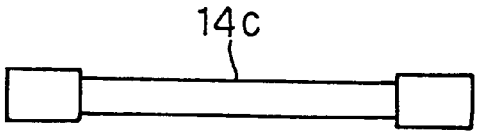
Figure 5C:
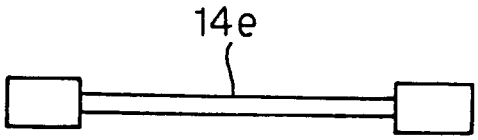
Figure 6:
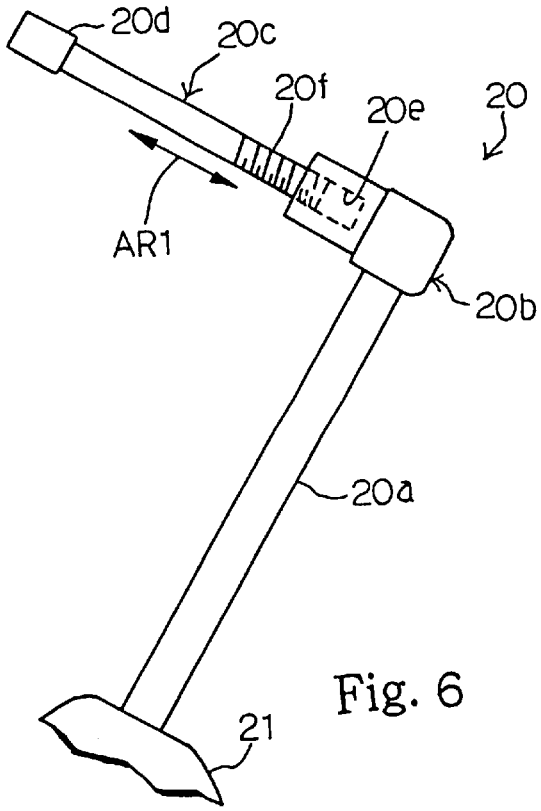
FIG. 6 is a side view showing a hammer incorporated in another keyboard musical instrument according to the present invention.
Figure 7:
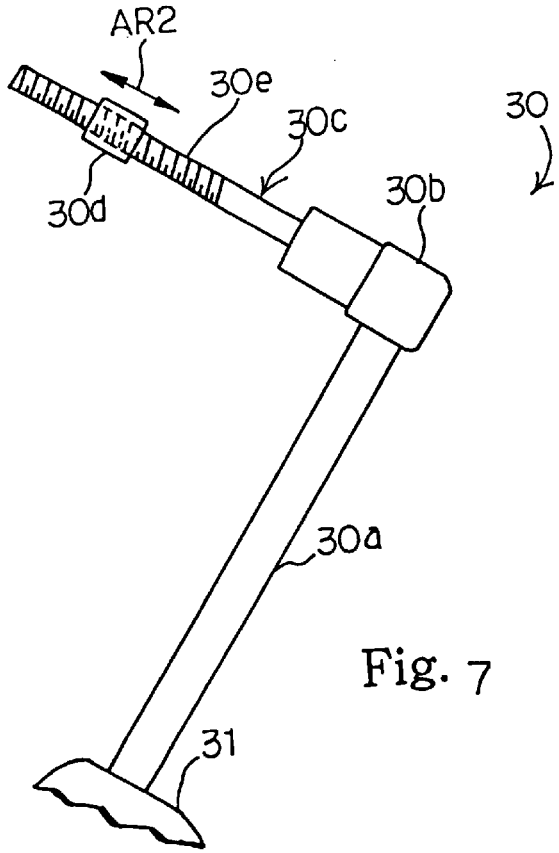
FIG. 7 is a side view showing a hammer incorporated in yet another keyboard musical instrument according to the present invention.

FIG. 3 illustrates the hammer 14. In this instance, a hammer shank 14*a*, a connector 14*b* and a weight 14*c* as a whole constitute the hammer 14. The hammer shank 14*a* is straight, and is connected at one end thereof to the butt 13*k*. The connector 14*b* is connected to the other end of the hammer shank 14*a*, and the weight is connected to the hammer shank 14*a* by means of the connector 14*b*. The weight is also straight, and projects from the connector 14*b* at right angle with respect to the hammer shank 14*a*. The weight 14*c* is one of the three variations 14*c*/14*d*/14*e* shown in FIGS. 5A to 5C. In other words, the manufacturer replaces the weight 14*c* with one of the weights 14*d* and 14*e* depending upon the associated black/white key 12*a*/ 12*b*.

An acoustic upright piano has black/white keys assigned notes of the scale, respectively, and a player selectively depresses the black/white keys so as to strike sets of strings with hammers. The sets of strings vibrate at respective fundamental frequencies different from one another. The strings are different in thickness from one another, and, accordingly, the hammer heads are regulated to different weighs. The manufacturer may use three kinds of hammer heads in the corresponding acoustic upright piano. The heavy hammer head is used for generating the lower-pitched part, and the sets of strings in the higher-pitched part are struck with the light hammer heads. The middle-pitched part is assigned the hammer head regulated between the heavy hammer head and the light hammer head.

The three kinds of weights 14*d*/14*e*/14*c* are corresponding to the heavy hammer head, the light hammer head and the middle hammer head, respectively. The weight 14*d* is heavier than the other weights 14*c* and 14*e*, and is used for the hammers 14 associated with the black/white keys 12*a*/ 12*b* for the lower-pitched part. The weight 14*c* is lighter than the weight 14*d* but is heavier than the weight 14*e*. For this reason, the weight 14*c* is used for the hammers 14 associated with the black/white keys 12*a*/12*b* for the middle-pitched part. The weight 14*e* is lighter than the other weights 14*d*/14*c*, and is used for the hammers 14 associated with the black/white keys 12*a*/12*b* for the higher-pitched part. In this instance, the three kinds of weights 14*d*/14*c*/14*e* are equal in weight to the three kinds of hammer heads incorporated in the corresponding acoustic upright piano, respectively. Although the configuration is varied between the three kinds of weights 14*c*/14*d*/14*e*, the material may be changed between the three kinds of weights. Otherwise, the three kinds of weights may be different in size without changing the configuration.

The three kinds of weights 14*d*/14*c*/14*e* have the centers of gravity, respectively, and the centers of gravity are offset from the center line of the hammer shank 14*a* by predetermined distances. The predetermined distances are approximately equal to the amounts of offset between the three kinds of hammer head and the center line of the associated hammer shank of the acoustic upright piano. The centers of gravity are closer to the hammer receiver 16 than the center line of the hammer shank 14*a*, and falls in a vicinity of the center of gravity of a hammer head incorporated in the acoustic upright piano. The vicinity may be determined with respect to the center line of the hammer shank 14*a*. The center of gravity in the hammer 14 offers the load against the escape between the jack 13*b* and the butt 13*k*, and the player feels the key touch identical with or similar to the key touch of the acoustic upright piano.

Figure 2:
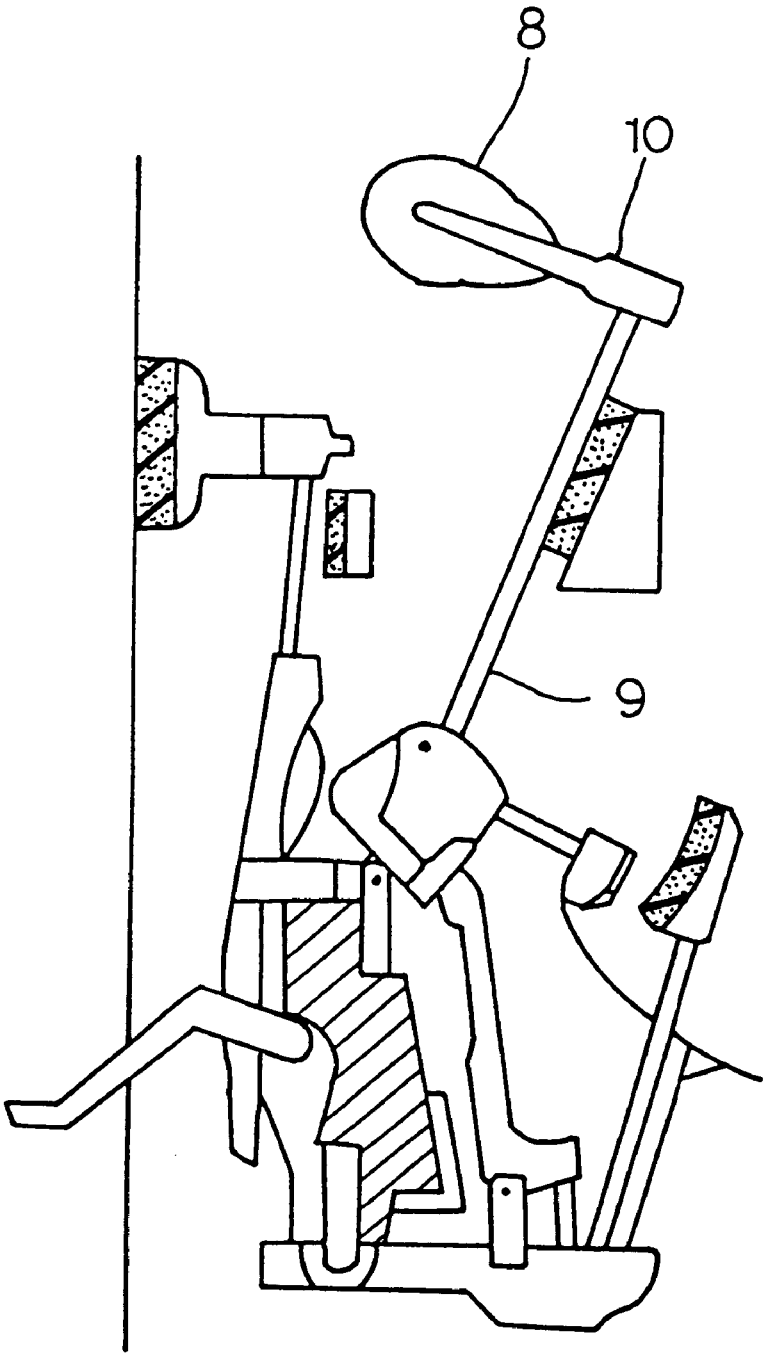
Fig. 2 PRIOR ART
FIG. 2 is a side view showing the hammer assembly incorporated in the prior art acoustic upright piano.

The weights 14*d*/14*c*/14*e* are much simpler than the hammer head, i.e., the hammer felt 8 and the hammer wood 10 (see FIG. 2). There is not any limitation on the configuration of the connector 14*b*, because the connector 14*b* is only expected to connect the weight 14*c*/14*d*/14*e* to the hammer shank 14*a*. If the hammer 14 is diverted to a keyboard musical instrument developed on the basis of a grand piano, the manufacturer is to regulate the connector 14*b* to an appropriate configuration, because the back check receives the connector 14*b* (see FIG. 2 of U.S. Pat. No. 5,811,702). Although the hammer disclosed in the U.S. patent has the hammer head extending in the perpendicular direction to the hammer shank, the center of gravity is never taken into account, and the manufacturer designs the hammer head for the back check.

The connector 14*b* without the limitation is simple and suitable for the mass-production. This means that the connector 14*b* is low in production cost. Thus, both of the connector 14*b* and the weight 14*c*/14*d*/14*e* are economically produced, and the manufacture produces the hammers 14 at a low cost.

Figure 1:
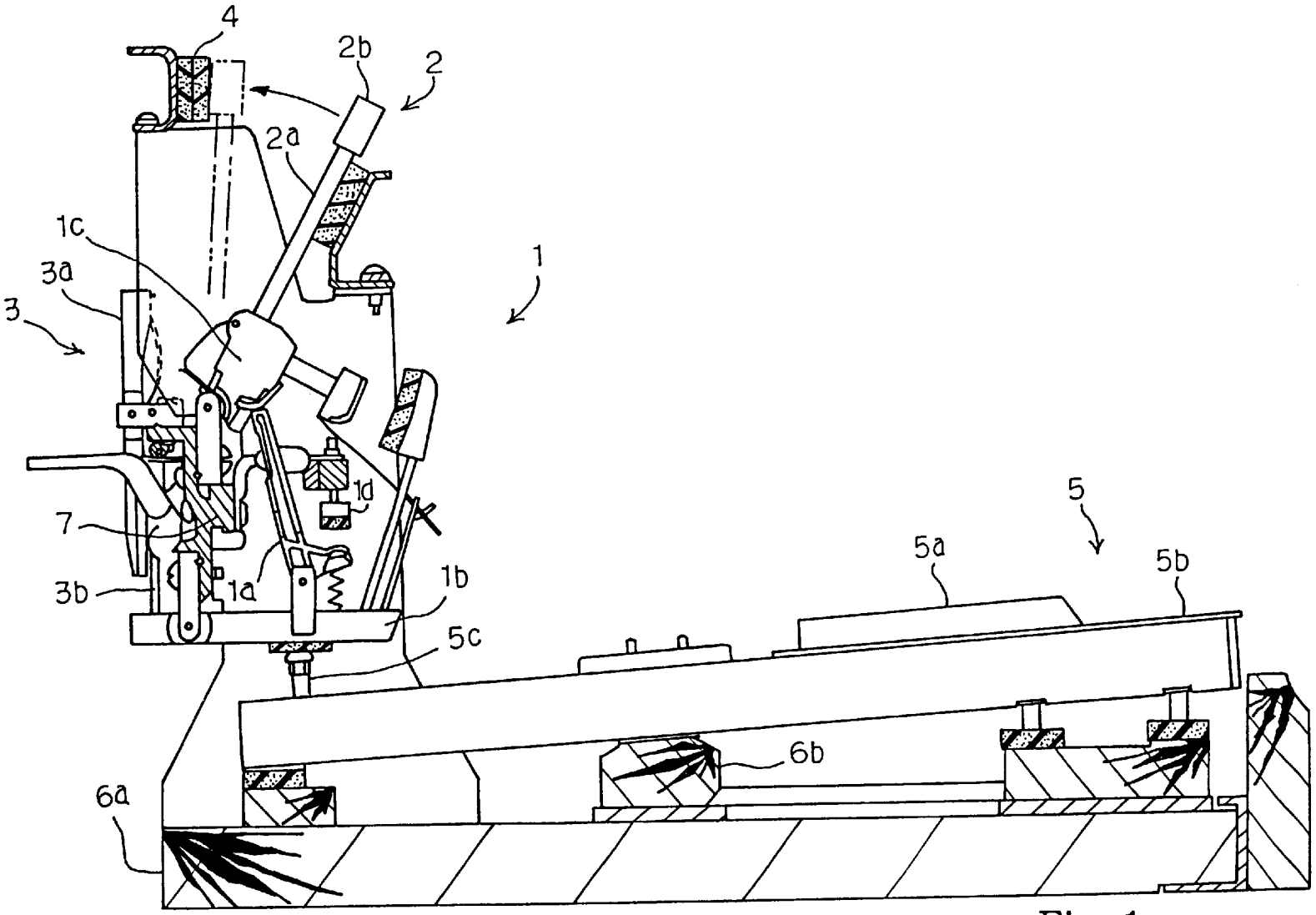
Fig. 1 PRIOR ART
FIG. 1 is a side view showing the structure of the prior art keyboard musical instrument.

Turning back to FIG. 1, reference 14*f* designates a hammer rail laterally extending between the action brackets 11*d*, and a hammer rail pad 14*g* is attached to the rear surface of the hammer rail 14*f*. After rebounding on the hammer receiver 16, the hammer shanks 14*a* stops to rest on the hammer rail pad 14*g*.

The dummy damper mechanism 15 includes a damper spoon 15*a*, a damper flange 15*b*, a damper lever 15*c* and a damper spring 15*d*. The damper flange 15*b* is fixed to the upper surface of the center rail 11*c*, and the damper lever 15*c* is rotatably connected to the damper flange 15*b*. The damper spring 15*d* is provided between the damper flange 15*b* and the upper portion of the damper lever 15*c*, and urges the damper lever 15*c* to turn in the counter clockwise direction at all times. The damper spoon 15*a* is fixed to the rear end portion of the whippen 13*g*, and the damper spring 15*d* causes the lower portion of the damper lever 15*c* to be held in contact with the damper spoon 15*a*. Although a damper head is connected through a damper wire to the upper portion of the damper lever in the damper mechanism of the acoustic upright piano, the dummy damper mechanism 15 does not have any damper head nor any damper wire, because the hammer receiver 16 does not vibrate at the strike with the hammer 14. The dummy damper mechanism 15 is provided for applying a load against the key motion.

The dummy damper mechanism 15 is linked with a damper rod 17, which in turn is connected to a damper pedal (not shown). When the player depresses the damper pedal, the damper rod 17 is rotated, and the damper rod 17 causes all the damper levers 15*c* to turn in the clockwise direction. As a result, the lower portions of the damper levers 15*c* are spaced from the associated damper spoons 15*a*, respectively. In this situation, even if the black/white key 12*a*/12*b* is depressed, the damper spoon 15*a* does not push the associated damper lever 15*c*, and the load against the key motion is reduced as similar to the acoustic upright piano.

The hammer receiver 16 includes a bracket 16*a*, a damper 16*b* and a cushion 16*c*. The bracket 16*a* laterally extends, and is supported by the action brackets 11*d*. The bracket 16*a* may be formed of cast iron, which effectively damps vibrations. The damper 16*b* is formed of rubber or synthetic resin such as, for example, polyurethane, and is attached to the front surface of the bracket 16*a*. The damper 16*b* is covered with the cushion 16*c*, and the cushion 16*c* is formed of rubber, synthetic resin, leather, cloth or felt. Even though the hammers 14 repeats the impact, the cushion 16*c* prevents the damper 16*b* from the impact, and the damper 16*b* is hardly damaged.

The bracket 16*a* keeps the lamination of the damper and the cushion 16*b*/16*c* at the position where the hammer shanks 14*a* rebound. The weights 14*c*/14*d*/14*e* pass over the hammer receiver 16, and are never brought into collision with any part of the keyboard musical instrument.

The hammer receiver 16 at the current position makes the inner space narrow. If the weights 14*c*/14*d*/14*e* rebound on the hammer receiver 16, the manufacturer needs to rearwardly move the hammer receiver 16 rather than the current position, and the case 11 becomes large. Moreover, the hammer receiver 16 at the current position makes the hammers 14*c*/14*d*/14*e* durable. If the hammer receiver 16 is provided in a certain position higher than the current position, the hammer receiver 16 is struck with the weights 14*c*/14*d*/14*e*. The reaction is exerted on the leading end of the weight 14*c*/14*d*/14*e*, and generates a bending moment around the connector 14*b*. If the bending moment is repeatedly exerted on the connector 14*b*, the connection between the connector 14*b* and the weight 14*c*/14*d*/14*e* is broken.

The keyboard musical instrument further comprises an electronic system 18 for generating electronic sounds. The electronic system 18 includes plural key sensors 18*a* respectively associated with the black/white keys 12*a*/12*b*, a tone generator 18*b* connected to the plural key sensors 18*a*, a speaker system 18*c* and a headphone 18*d*. A shutter plate 18*e* and photo-couplers 18*f* as a whole constitute the key sensor 18*a*. The shutter plate 18*e* is attached to the lower surface of the associated black/white key 12*a*/ 12*b*, and photo-couplers 18*f* are provided on the trajectory of the shutter 18*e*. The shutter plate 18*e* sequentially interrupts the optical beams of the photo-couplers 18*f*, and supplies a key position signal to the tone generator 18*b*. The tone generator 18*b* determines the key code assigned to the depressed key, and gives an envelope to an oscillating signal. Thus, the tone generator 18*b* generates an electric signal representative of the note assigned to the depressed key, the timbre and the loudness proportional to the key velocity, and supplies the electric signal to the speaker system 18*c* and/or the headphone 18*d*. The speaker system 18*c* and/or the headphone produces the electronic sound corresponding to the acoustic sound of the acoustic upright piano.

The player releases the depressed key, and the key returns toward the rest position. The shutter plate 18*e* sequentially goes out of the optical paths of the photo-couplers 18*f*, and the tone generator 18*b* terminates the generation of the electric signal. Then, the electronic sound is extinguished.

Description is hereinbelow made on the behavior of the keyboard musical instrument. While a player is playing a tune on the keyboard musical instrument, the player depresses one of the black/white keys 12*a*/12*b*, the black/white key 12*a*/12*b* is moved from the rest position toward the end portion, and upwardly pushes the capstan button 12*g*. The whippen 13*g* turns around the whippen flange 13*f* in the counter clockwise direction, and the jack 13*b* and the damper spoon 15*a* also turn around the whippen flange 13*f* without any relative motion to the whippen 13*g*. The jack 13*b* pushes the butt skin 13*q*, and the butt 13*k* and the hammer 14 slowly turn around the butt flange 13*m* in the counter clockwise direction. The damper spoon 15*a* pushes the lower portion of the damper lever 15*c*, and causes the damper lever 15*c* to turn around the damper flange 15*b* in the clockwise direction. The weight 14*c* generates the moment around the butt flange 13*m*, and gives the load against the key motion through the jack 13*b*, the whippen 13*g* and the capstan button 12*g*. The damper lever 15*c* also exerts a reaction on the damper spoon 15*a* and, accordingly, the capstan button 12*g*. For this reason, the player feels the black/white key 12*a*/12*b* heavy. The toe 13*j* is getting closer and closer to the regulating button 13*u*.

When the toe 13*j* is brought into contact with the regulating button 13*u*, the reaction is exerted on the toe 13*j*, and generates the moment around the jack flange 13*h* in the clockwise direction. The player feels the black/white key 12*a*/12*b* heavier. The weight 14*c* causes the hammer 14 to vary the load as similar to the hammer felt 8 and the hammer head 10, and the player feels the key touch usual.

The jack 13*b* quickly turns around the jack flange 13*h* in the clockwise direction, and the butt 13*k* escapes from the jack 13*b*. The load is removed from the black/white key 12*a*/12*b*, and the player suddenly feels the black/white key 12*a*/12*b* light. Thus, the key touch is identical with that of the acoustic upright piano.

The jack 13*b* is brought into contact with the jack stop rail felt 13*x*, and the hammer 14 starts the free rotation toward the hammer receiver 16. As described hereinbefore, the key sensor 18*a* monitors the black/white key 12*a*/12*b*, and reports the key motion to the tone generator 18*b*. When the hammer shank 14*a* strikes the cushion 16*c* and the damper 16*b*, the tone generator 18*b* supplies the electric signal to the speaker system 18*c* and/or the headphone 18*d*, and the electric sound is generated from the speaker system 18*c* and/or the headphone 18*d*. However, the hammer receiver 16 merely generates faint noise, because the damper 16*b* takes up the impact of the hammer 14.

The hammer 14 rebounds on the cushion 16*c*. The hammer 14 returns toward the hammer rail pad 14*g*, and the catcher 13*n* returns toward the back check block 13*r*. The player releases the black/white key 12*a*/12*b*, and the black/white key 12*a*/12*b* starts to return toward the rest position. The key action mechanism 13 follows the capstan button 12*g*, and turns around the whippen flange 13*f* in the clockwise direction. The damper spring 15*d* urges the damper lever 15*c* to turn in the counter clockwise direction, and the jack 13*b* slides into the lower space of the butt 13*k*.

The shutter plate 18*e* sequentially goes out of the optical paths of the photo-couplers 18*f*, and the photo-coupler 18*f* reports the key motion to the tone generator 18*b*. When the dummy damper mechanism 15 is recovered to a certain position where the damper head of the corresponding acoustic upright piano is brought into contact with the strings, the tone generator 18*b* terminates the electric signal, and the electronic sound is extinguished.

In the first embodiment, the connector 14*b* and the weight 14*c* as a whole constitute a weight member.

As will be understood from the foregoing description, the hammer 14 has the weight 14*c*/14*d*/14*e* projecting toward the hammer receiver 16, and the weight 14*c*/14*d*/14*e* has the center of gravity offset from the center line of the hammer shank 14*a*. As a result, the hammer 14 gives the load varied as similar to the hammer of an acoustic upright piano against the key motion, and the player feels the key touch identical with that of the acoustic upright piano.

Second Embodiment

Another keyboard musical instrument embodying the present invention is similar to the keyboard musical instrument shown in FIG. 3 except for the hammers. The hammers of the second embodiment have the external appearances similar to those shown in FIGS. 5A, 5B and 5C. However, the hammer used in the second embodiment is implemented by a single piece. As described hereinbefore, the hammer 14 is separable into the hammer shank 14*a*, the connector 14*b* and the weight 14*c*/14*d*/14*e*. However, the hammer used in the second embodiment merely has a shank portion and a weight portion integral with one another. The hammers used in the second embodiment may be molded.

The hammers used in the second embodiment is suitable for the mass-production, and the manufacturer further reduces the production cost of the keyboard musical instrument.

Third Embodiment

Yet another keyboard musical instrument embodying the present invention is similar to the keyboard musical instrument shown in FIG. 3 except for hammers 20. The hammer 20 projects from a butt 21, which is corresponding to the butt 13*k*, and a hammer receiver (not shown) is beaten with the hammer 20 without acoustic sound. The hammer receiver 16 is available for the keyboard musical instrument implementing the third embodiment.

The hammer 20 includes a hammer shank 20*a*, a connector 20*b*, a connecting rod 20*c* and a weight 20*d*. The hammer shank 20*a* is straight, and the connector 20*b* is fixed to the leading end of the hammer shank 20*a*. A hole 20*e* is formed in the connector 20*b*, and has a center axis perpendicular to the center line of the hammer shank 20*a*. A female screw is formed on the inner surface defining the hole 20*e*. The connecting rod 20*c* is also straight, and a male screw 20*f* is formed on the outer surface of one end portion of the connecting rod 20*c*. The male screw 20*f* is engaged with the female screw, and the male screw 20*f* and the female screw make the connecting rod perpendicular to the hammer shank 20*a*. The weight 20*d* is fixed to the other end portion of the connecting rod 20*c*. In this instance, the connector 20*b*, the connecting rod 20*c* and the weight 20*d* as a whole constitute a weight member.

A tuner regulates the center of gravity in the weight 20*d* assembled with the connecting rod 20*c* to an appropriate point by turning the connecting rod 20*c* as indicated by arrow AR1. The center of gravity fall into a vicinity of a center of gravity in the hammer head incorporated in a corresponding upright piano. The center of gravity is closer to the hammer receiver than the center line of the hammer shank 20*a*, and the appropriately regulated center of gravity gives a key touch similar or identical with the piano key touch to the player.

The connecting rod 20*c* and, accordingly, the weight 20*d* are detachable from the connector 20*b*. If the connecting rod 20*c* is damaged, it is replaced with a new connecting rod 20*c* and a weight 20*d* attached thereto without disassembly of the key action mechanism. Thus, the hammers 20 allow the manufacturer to easily repair the keyboard musical instrument implementing the third embodiment.

The hammers 20 are different in weight between the associated black/white keys. The manufacture may prepare three kinds of hammers 20 for the higher-pitched part, the middle-pitched part and the lower-pitched part. The manufacturer varies the volume of the weights 20*d* so as to prepare the different kinds of hammers 20. The manufacturer may change the configuration of the weight 20*d*, or form a spiral groove different in depth and/or width in the weight 20*d*. Otherwise, the manufacturer may change the material. The other parts, i.e., the hammer shank 20*a*, the connector 20*b* and the connecting rod 20*c* are commonly used for the hammers 20, and the manufacturer reduces the production cost of the hammers 20.

By virtue of the hammers 20, the keyboard musical instrument implementing the third embodiment achieves the key touch identical with that of an acoustic upright piano.

Fourth Embodiment

Still another keyboard musical instrument embodying the present invention is similar to the keyboard musical instrument shown in FIG. 3 except for hammers 30. The hammer 30 projects from a butt 31, which is corresponding to the butt

13*k,* and a hammer receiver (not shown) is beaten with the hammer 30 without acoustic sound. The hammer receiver 16 is available for the keyboard musical instrument implementing the fourth embodiment.

The hammer 30 includes a hammer shank 30*a,* a connector 30*b,* a threaded rod 30*c* and a ring weight 30*d.* The hammer shank 30*a* is straight, and the connector 30*b* is fixed to the leading end of the hammer shank 30*a.* The threaded rod 30*c* is fixed to the connector 30*b,* and projects therefrom toward the hammer receiver. The threaded rod 30*c* has a center line substantially perpendicular to the center line of the hammer shank 30*a.* A male screw 30*e* is formed on the outer surface of the threaded rod 30*e,* and is engaged with a female screw formed on the inner surface of the ring weight 30*d.* The ring weight 30*d* is movable in the direction indicated by arrow AR2. In this instance, the connector 30*b,* the threaded rod 30*c* and the ring weight 30*d* as a whole constitute a weight member.

The ring weight 30*d* is varied in weight between the associated black/white keys. Three kinds of ring weights 30*d* may be prepared for the lower-pitched part, the middle-pitched part and the higher-pitched part. The hammers 30 achieve all the advantages of the hammers 20.

As will be appreciated from the foregoing description, the present invention is made on the basis of the discovery that the center of gravity in the weight affects the key touch, and Although particular embodiments of the present invention have been shown and described, it will be obvious to those skilled in the art that various changes and modifications may be made without departing from the spirit and scope of the present invention.

Players usually have individual sensitivities to the key touch. Professional pianists may have severe sensitivity, but beginner's sensitivity is usually rough. Therefore, it is unnecessary to adjust the centers of gravity in the weights to positions strictly identical with the centers of gravity in the hammer heads incorporated in a corresponding acoustic upright piano. The centers of gravity in the weights may be in the vicinity of the centers of gravity of the hammer heads in so far as the player feels the key touch identical with the piano key touch. In other words, the manufacturer may vary the strictness depending upon the users of the keyboard musical instrument.

A case and the keyboard 12 may give an external appearance different from an acoustic upright piano to the keyboard musical instrument according to the present invention.

If the difference in weight between the hammer heads of a corresponding acoustic upright piano is negligible, the weights 14*c* may be attached to all the hammer shanks 14*a.*

A dummy weight may be attached to the damper lever 15*c.* The electronic system 18 may be deleted from the keyboard musical instrument. Using the keyboard musical instrument, a player may simply practice the fingering on the keyboard.

The key sensors 18*a* may be replaced with piezoelectric elements to be depressed by the keys 12*a*/12*b* or the hammers 14. In this instance, the tone generator may vary the loudness depending upon the intensity of the impact.

The hammer may be integral with the butt. In this instance, the catcher 13*n* may be further integral with the butt and the hammer. The connecting rod 20*c* and the ring weight 30*d* may be locked to the connector 20*b* and the threaded rod 30*c* by means of a suitable lock member such as, for example, a pair of nuts.

Finally, the hammers 14/20/30 may be formed from parts different in material. These hammers have a weight distribution identical with or similar to the hammers of an acoustic piano.

What is claimed is:

1. A keyboard musical instrument comprising:

a keyboard including plural keys independently turnable between respective rest positions and respective end positions and assigned notes of a scale, respectively;

plural key action mechanisms having components corresponding to key action mechanisms of an acoustic piano, respectively linked with said plural keys, the components including respective butts and respective jacks, and selectively actuated by depressed keys of said keyboard so as to rotate said butts through escapes from said jacks associated therewith;

a hammer receiver to be struck without acoustic sound; and plural hammers driven for rotation together with said butt for striking said hammer receiver, and including respective hammer shanks having respective center lines and fixed to the associated butts and respective weight members attached to the associated hammer shanks and having centers of gravity closer to said hammer receiver than said center lines of said associated hammer shanks.

2. The keyboard musical instrument as set forth in claim 1, in which the center of gravity of each of said weight members falls within a vicinity of a center of gravity of a hammer head of a hammer corresponding to said each of said weight members and incorporated in said acoustic upright piano.

3. The keyboard musical instrument as set forth in claim 1, in which said weight members are different in weight.

4. The keyboard musical instrument as set forth in claim 3, in which said weight members are divided into three groups associated with the keys of said keyboard assigned a higher-pitched part, the keys of said keyboard assigned a middle-pitched part and the keys of said keyboard assigned a lower-pitched part, respectively, and the weight members for said keys assigned said middle-pitched part are lighter than said weight members for said keys assigned said higher-pitched part and heavier than said weight members for said keys assigned said lower-pitched part.

5. The keyboard musical instrument as set forth in claim 4, in which the center of gravity of each of said weight members falls within a vicinity of a center of gravity of a hammer head of a hammer corresponding to said each of said weight members and incorporated in said acoustic upright piano.

6. The keyboard musical instrument as set forth in claim 1, in which said centers of gravity are independently moved from current positions to other positions in said weight members with respect to said center lines of said hammer shanks, respectively.

7. The keyboard musical instrument as set forth in claim 6, in which each of said weight members includes a connecting member projectable from and retractable toward the center line of the associated one of said hammer shanks and a weight connected to a leading end of said connecting member.

8. The keyboard musical instrument as set forth in claim 7, in which said each of said weight members further includes a connector attached to the leading end of said hammer shank and having a hole defined by a threaded inner surface, and said connecting member has a threaded outer surface inserted into said hole so as to engage said threaded outer surface with said threaded inner surface.

9. The keyboard musical instrument as set forth in claim 6, in which each of said weight members includes a guide member projecting from the associated one of said hammer shanks and stationary with respect to said associated one of said hammer shanks and a weight movable along said guide member.

10. The keyboard musical instrument as set forth in claim 9, in which said guide member has a threaded outer surface, and said weight is shaped into a ring having a through-hole defined by a threaded inner surface engaged with said threaded outer surface.

11. The keyboard musical instrument as set forth in claim 1, in which said hammer shanks rebound on said hammer receiver.

12. The keyboard musical instrument as set forth in claim 11, in which the center of gravity of each of said weight members falls within a vicinity of a center of gravity of a hammer head of a hammer corresponding to said each of said weight members and incorporated in said acoustic upright piano so that a player feels a key touch on associated one of said plural keys similar to a key touch on a key of said acoustic upright piano.

13. The keyboard musical instrument as set forth in claim 12, in which said weight members are divided into three groups associated with the keys of said keyboard assigned a higher-pitched part, the keys of said keyboard assigned a middle-pitched part and the keys of said keyboard assigned a lower-pitched part, respectively, and the weight members for said keys assigned said middle-pitched part are lighter than said weight members for said keys assigned said higher-pitched part and heavier than said weight members for said keys assigned said higher-pitched part.

14. The keyboard musical instrument as set forth in claim 13, in which in which each of said weight members includes a connecting member projectable from and retractable toward the center line of the associated one of said hammer shanks and a weight connected to a leading end of said connecting member.

15. The keyboard musical instrument as set forth in claim 14, in which said each of said weight members further includes a connector attached to the leading end of said hammer shank and having a bole defined by a threaded inner surface, and said connecting member has a threaded outer surface inserted into said hole so as to engage said threaded outer surface with said threaded inner surface.

16. The keyboard musical instrument as set forth in claim 13, in which each of said weight members includes a guide member projecting from the associated one of said hammer shanks and stationary with respect to said associated one of said hammer shanks and a weight movable along said guide member.

17. The keyboard musical instrument as set forth in claim 16, in which said guide member has a threaded outer surface, and said weight is shaped into a ring having a through-hole defined by a threaded inner surface engaged with said threaded outer surface.

18. The keyboard musical instrument as set forth in claim 1, further comprising plural dummy damper mechanisms respectively linked with said plural key action mechanisms and applying a load to said depressed keys.

19. The keyboard musical instrument as set forth in claim 18, further comprising an electric sound generating system responsive to said depressed keys so as to electrically generate sounds having the notes of said scale assigned to said depressed keys.

20. The keyboard musical instrument as set forth in claim 1, in which said hammer receiver includes a stationary member extending over said keyboard, a damper layer attached to said stationary member for absorbing impacts of said hammers and a cushion layer durable and attached to said damper layer.

21. The keyboard musical instrument as set forth in claim 20, in which said stationary member is formed of cast iron, said damper layer is formed of a material selected from the group consisting of rubber and synthetic resin, and said cushion layer is formed of a material selected from the group consisting of rubber, synthetic resin, leather, cloth and felt.

22. A keyboard musical instrument comprising:

a keyboard including plural keys laid out on a pattern of an acoustic upright piano, independently turnable between respective rest positions and respective end positions, and assigned notes of a scale, respectively;

plural key action mechanisms similar to key action mechanisms of said acoustic upright piano, respectively linked with said plural keys, having respective butts and respective jacks, and selectively actuated by depressed keys of said keyboard so as to rotate said butts through escapes from said jacks associated therewith;

a hammer receiver to be struck without acoustic sound; and plural hammers driven for rotation together with said butt for striking said hammer receiver, and including respective hammer shanks having respective center lines and fixed to the associated butts and respective weight members attached to the associated hammer shanks and having centers of gravity closer to said hammer receiver than said center lines of said associated hammer shanks and movable from and toward said center lines.

23. The keyboard musical instrument as set forth in claim 20, in which said hammer shanks rebound on said hammer receiver after said escapes.

24. The keyboard musical instrument as set forth in claim 23, in which the center of gravity of each of said weight members falls within a vicinity of a center of gravity of a hammer head of a hammer corresponding to said each of said weight members and incorporated in said acoustic upright piano so that a player feels a key touch on associated one of said plural keys similar to a key touch on a key of said acoustic upright piano.

* * * * *